United States Patent [19]

Böttcher et al.

[11] Patent Number: 4,527,793

[45] Date of Patent: Jul. 9, 1985

[54] MONITORING DEVICE FOR MONITORING BOOK BLOCK FORMATION

[75] Inventors: Rolf Böttcher, Markkleeberg; Rolf Heise; Helmut Praxator, both of Leipzig, all of German Democratic Rep.

[73] Assignee: VEB Kombinat Polygraph "Werner Lamberz" Leipzig, Leipzig, German Democratic Rep.

[21] Appl. No.: 343,072

[22] Filed: Jan. 27, 1982

[30] Foreign Application Priority Data

Mar. 19, 1981 [DD] German Democratic Rep. ... 228434
Dec. 22, 1981 [DD] German Democratic Rep. ... 236087

[51] Int. Cl.[3] ..... B65H 7/12
[52] U.S. Cl. ..... 271/263; 209/603
[58] Field of Search ..... 271/262, 263; 209/603

[56] References Cited

U.S. PATENT DOCUMENTS 3,679,202 7/1972 Rauffer ..... 271/263
3,713,646 1/1973 Derc ..... 271/263
4,378,109 3/1983 Takahashi ..... 271/263

*Primary Examiner*—Richard A. Schacher

*Attorney, Agent, or Firm*—Jordan and Hamburg

[57] ABSTRACT

The monitoring device serves to monitor the formation of bookblocks at depositing stations for collating machines and to release a control impulse at faulty formation of a bookblock. The object of the invention is to accomplish the formation of bookblocks on collating machines, provided with suction drums, and to reduce expenses of adjusting the machine for processing of varying paper thicknesses. The object is to construct a device, in such a manner that the precalculated position of a contact lever may be simply adjusted upon a base plate corresponding to any paper thickness and that the smallest deviations of position of the contact lever in one or another direction may be deleted while ensuring regularity of signal.

According to the invention, this object is accomplished by fastening at least one spring mounted stop for setting the precalculated position of the contact lever upon a base plate which is movably disposed relative to the machine frame. A change of voltage is read by a transmitter, as the equivalent for the deviation of the contact lever, with a tap connected to two threshold switches through a amplifier.

7 Claims, 5 Drawing Figures

Thick sheet or double sheet

Correct sheet

MONITORING DEVICE FOR MONITORING BOOK BLOCK FORMATION

BACKGROUND OF THE INVENTION AND PRIOR ART STATEMENT

The invention relates to a monitoring device for monitoring the formation of sheets at individual feeder stations for collating machines and for the release of a control impulse for defective formation of bookblocks.

A device is known according to DD-PS No. 58 058, in collating machines furnished with feed grippers, which stops the operation of the drive of the machine as soon as the grippers catch either no sheet or a double sheet in an operating phase. This device is furnished with two contact pairs, disposed upon a contact lever, which are closed in the precalculated position of the contact lever. The contact pairs are included for a short time in the circuit of the control device by a switching device controlled by the single revolution shaft of the machine. According to the setting of two set screws, the contact opens by means of a contact spring when the contact lever, furnished with contact pairs, deviates from the precalculated position. By this process, the circuit is interrupted when double sheets or defective sheets arrive and the machine is stopped.

The adaptation of the described sheet control-and switching-device to the processing of papers of differing thicknesses is carried out by adjusting the stop screws. The disadvantage here is that the two stop screws have to be manually adjusted at each feed station.

The object of the invention is to accomplish monitoring of the formation of bookblocks at individual feed stations for collating machiines furnished with suction drums and having high cycle rates and to release a control impulse when faulty formation of bookblocks occurs, along with reducing expenses for setting the device for processing of paper of varying thicknesses.

Thus, the invention is based upon the object of creating a device for monitoring the formation of bookblocks in such a manner, that the precalculated position of a contact lever corresponding to any thickness of paper may simply be set upon the base plate and that the smallst deviations of the contact lever in one or the other direction are detected while ensuring regularity of signal and avoiding the influence of vibrations at high cycle rates.

SUMMARY OF THE INVENTION

According to the invention, this object is accomplished by preferably fastening at least one spring mounted backstop for the adjustment of the precalculated position of the contact lever upon a base plate movably disposed in relation to the frame of the machine.

Based upon a fundamental position of the device for a definite paper thickness, the backstops or the backstop for the contact lever are set for operation with paper of differing thickness, by changing the position of the base plate relative to the machine frame by the amount of the deviation. For this purpose, the base plate is movably fastened, preferably rotatably, to the machine frame, and the contact lever is mounted upon the same axle on the machine frame. The base plate is rotated by the same angle when the longitudinal axis of the contact lever deviates in one or the other direction from the starting position. The desired precalculated position is thereby sustained when operating with varying paper thicknesses. The required rotation of the base plate is simply obtained by clamping a sample sheet between the base plate and a fixed placement point A', disposed at a finite distance from the fulcrum. Thus the expense of setting the device for operating at varying paper thicknesses is reduced to a minimum.

When the contact lever is rotated from its median position during operation by a double sheet or a defective sheet, it presses a spring mounted backstop back against the action of the spring. This change of position generates a control impulse, dependent on the direction of the rotation. For this purpose, it is transferred at a predetermined ratio through a lever, pivoted in a fulcrum and read on a transmitter as a change of voltage as a measure of the deflection. An interconnected tape off transmitter makes it possible to detect deviations starting from a precalculated position on the sensing roller, on the order of magnitude of $<0.1$ mm. A transmitter pin is preferably fastened at the end of the contact lever where difference of insertion depth at deviations of the contact lever while tapping the transmitter, cause a change of voltage, which controls two threshold switches through an amplifier connected in series. As a function of one of the two threshold switches responding, a faulty or double placement at the placement station is signaled. A change of voltage, though, may also be obtained at a deviation of the contact lever by means of a diaphragm, provided at the end of the contact lever, the precalculated position of said diaphragm being aligned with the position of a light guide cable and an electro-optical transmitter. The change of potential is then read by the electro-optical transmitter, which registers differing light values as a function of size and direction of the deviation from the precalculated position of the contact lever. The influences of the vibrations transferred from the machine to the device, are compensated by a diaphragm aperture, larger in relation to the cross section of the light guide cable. It is advantageous to provide a diaphragm with a variable diaphragm aperture in order to influence the reading sensitivity of the monitoring device.

Using this construction of the monitoring device for monitoring the formation of bookblocks, reliability of indication is obtained even at low cycle numbers. For smaller requirements, for instance at lower cycle rates, the control impulse is produced by the change of position at the contact lever and the closing of the electric circuit, whereby the contact pairs are formed as non-contact devices according to the invention, for instance as slotted initiators.

This device also makes it possible to control the omission of deposited sheets.

BRIEF DESCRIPTION OF THE DRAWINGS

The drawing illustrates three embodiments of the invention.

DETAILED DESCRIPTION OF PREFERRED EMBODIMENTS

Figure 1:
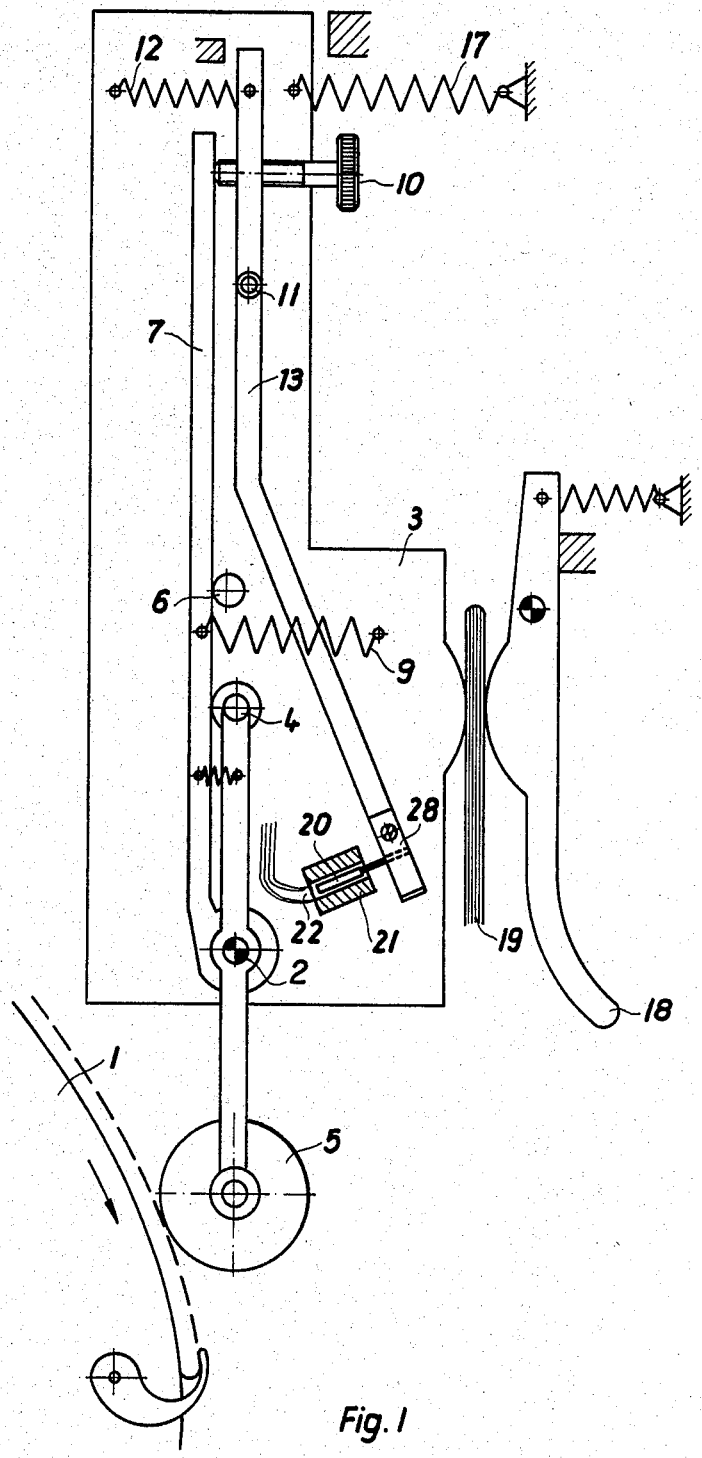
FIG. 1 illustrates a monitoring device with inductive sensor.

The monitoring device of the invention is mounted at a distance from the deposition drum 1 upon the common axle 2 of the base plate 3 in the machine frame (not shown), the contact lever 4 being located on the axle 2. The sensing roller 5 is pivotably disposed upon contact lever 4. The movable bifurcation 7 is pulled by a spring 9 against the stationary backstop 6. The contact lever 13 is flexibly contacted to the bifurcation 7 by the stop screw 10.

In the embodiment according to FIG. 1, a transmitter pin 20 is fastened to contact lever 13 by a sheet clamp 28 and is inserted according to the position of the contact lever 13 in a cylindrical recess of transmitter 21 with tap 22.

The base plate 3 is urged to by means of spring 17, a stably supported rotating lever 18 and a deposited sheet 19.

The precalculated position of the contact lever 4 upon the base plate 3 or the precalculated depth of insertion of transmitter pin 20 respectively, correspond to the precalculated distance of the sensing roller 5 from the feed drum 1. Correction of the position of the base plate 3 keeps the precalculated position constant when processing varying paper thicknesses. This adaption to varying paper thicknesses is performed by clamping a sample sheet of the goods to be processed between two positioning points of the rotating lever 18 and the base plate 3.

Figure 2:
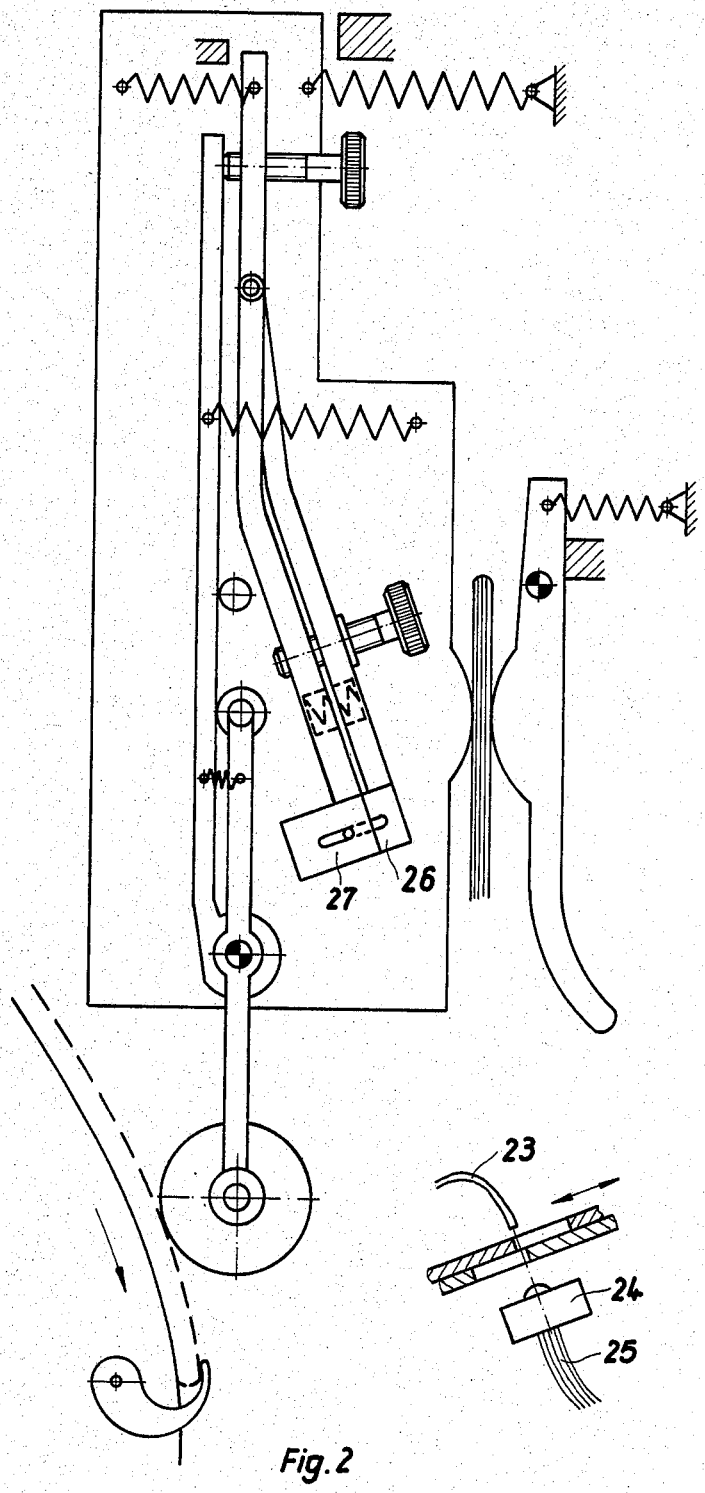
FIG. 2 illustrates a monitoring device with electro-opticalmechanical sensor.
Figure 3:
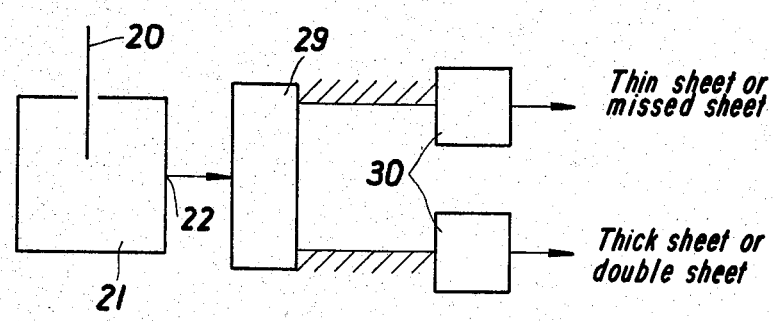
FIG. 3 illustrates a block diagram for a monitoring device with an inductive sensor.

The bifurcation 7 presses away from stop 6 against the force of the spring when the operating position of the contact lever 4 is moved by a double—or faulty sheet out of its precalculated position. This change of position is transferred through stop screw 10 to contact lever 13 and causes a change of depth of insertion of the transmitter pin 20 and a change of voltage on tap 22 of the transmitter 21. In the embodiment of the monitoring device according to FIG. 2, a diaphragm 26 with an adjustable diaphragm aperture 27 is provided at the end of the contact lever 13 instead of transmitter pin 20, the precalculated or reference position of the diaphram 26 being aligned with the position of a light guide cable 23 and a photoelectric transmitter 24. According to intensity and direction of the deviation of the contact lever 13 from the precalculated position, the light beam emitted by the light guide cable 23 is more or less brought to congruence, whereby differing light values are detected by the electro-optical transmitter 24 that is aligned with the light guide cable, thus causing a change of voltage on tap 25.

Due to the influences of the vibrations transferred to the device by the machine, the opening of the diaphragm must protrude over the cross sectional plane of the light guide cable. With aid of the construction, chosen in the embodiment according to FIG. 2 of diaphragm 26, the aperture 27 may be set by translating two slotted masks lying one above the other. Adaptability to any conditions each time is thereby made possible by setting the diaphragm whereby the response of the monitoring device may be controlled.

The change of potential, produced as a function of the position of the transmitter pin 20 is increased and causes one of the two threshold switches 30 to respond when certain limiting values are achieved, whereby a missing or double sheet is signaled.

Figure 5:
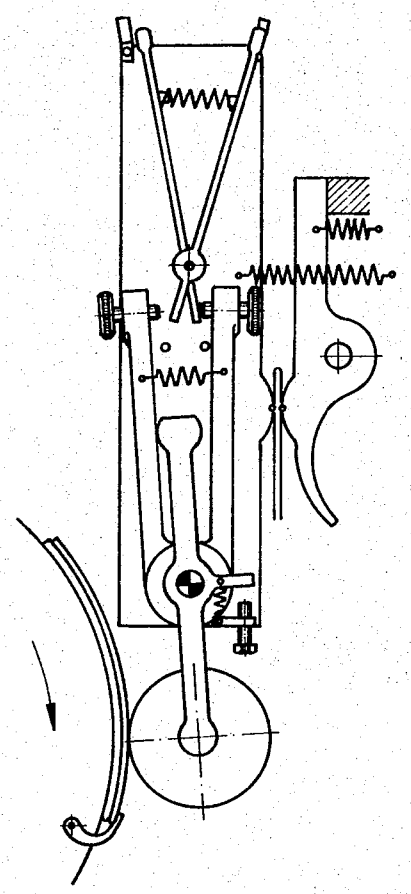
FIG. 5 illustrates a monitoring device with contact pairs and faulty formation of bookblocks.
Figure 4:
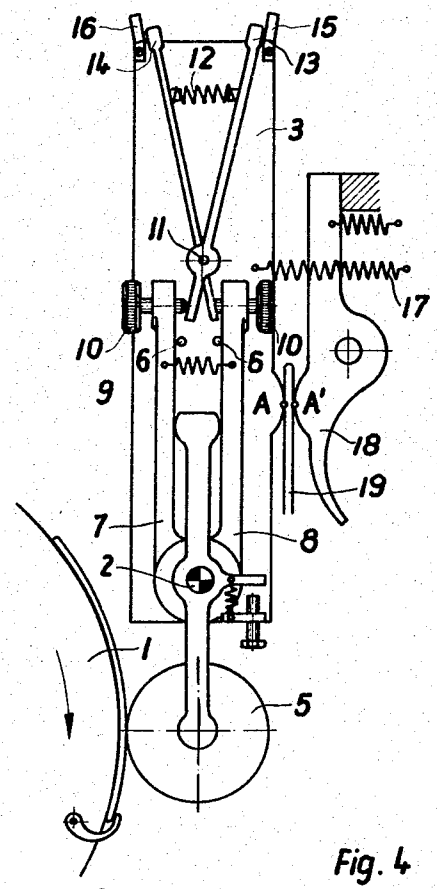
FIG. 4 illustrates a monitoring device with contact pairs and the correct feed of sheets.

In the embodiment according to FIGS. 4 and 5, two stationary backstops 6 are symmetrically disposed relative to the fulcrum 2. The bifurcations 7, 8 which are movable with respect to one another are pressed against the backstops 6 by a spring 9. Each of them supports a stop screw 10, abutted by two contact levers 13, 14, said contact levers 13, 14 being supported in a fulcrum 11, tensioned by a spring 12 and acting on the slotted initiator 15 or 16 in case of a deflection. When faulty formation of a bookblock occurs, for instance when double or missing sheets occur, the contact lever 4 deviates from its center position. By touching one of both bifurcations 7, 8, one stop screw 10 is moved against the force of the spring 9. That enables one of both contact levers 13, 14 to pivot around its fulcrum 11 and to act on a slotted initiator 15, 16. By shutting the electrical circuit, a control impulse is released which is only possible in certain phases in an operating cycle by the cycle controlled current emitter. The spring mounting of bifurcations 7, 8 prevents a strong deformation of the contact lever 4 when more than two or crumpled sheets are clamped, because it is capable of giving way against the action of spring 9.

We claim:

1. A device for monitoring the formation of bookblocks in a collating machine for detecting a missing sheet or faulty placement of more than one sheet at a time comprising, a base plate movably fastened to a frame of the machine, said base plate having means for fixing said base plate in a predetermined position, and an axis thereon, a contact lever pivotally mounted on said base plate on the axis, a second lever pivoted to said base plate on said axis, a stop mounted on said base plate at a position to inhibit angular displacement of said second lever in one direction beyond a pedetermined position while permitting angualar displacement of said lever in response to sheets that are too thick or too thin, an arm pivotally mounted on said base plate and adjustably coupled to said second lever, and means for signalling determined variations in the angular displacement of said contact lever, said signallying means including a device connected to said arm for signally deviation of the contact lever due to a missing sheet or faulty placement of more than one sheet or too thick a sheet or too thin a sheet.

2. The device of claim 1 in which said base plate is pivotally biased to said machine frame about said axis by a spring, said contact lever and said second lever are pivotably mounted on the axis of said base plate, said arm being pivotally connected to said base plate, a first spring biasing said arm to engage said second lever, a second spring biasing said second contact lever toward said stop, and a screw positioned in a hole in said arm and contacting said second lever.

3. The device of claim 2 additionally comprising a sensing roller pivotably disposed upon an axis of said first mentioned contact lever and contacting a deposition drum, and a rotatable lever pivoted to said machine frame opposite said base plate and resiliently biased toward said base plate, for forming a channel between said base plate and said rotatable lever in which a sample sheet or bookblock may be situated to fix the position of said base plate.

4. The device of claim 3 in which said signalling device comprises a transmitter pin affixed to the arm and positioned in a transmitter, whereby deviation of said transmitter pin results in the production of a signal by said transmitter indicating a missing sheet or faulty placement of more than one sheet or too thick a sheet or too thin a sheet.

5. The device of claim 3 in which said signalling device comprises a diaphragm containing an adjustable diaphragm aperture on said second contact lever and a light guide cable with photoelectric transmitter aligned with said diaphragm aperture, with deviation of said diaphragm aperture signalling a missing sheet or a faulty placement of more than one sheet or too thick a sheet or too thin a sheet.

6. The device of claim 5 in which said diaphragm aperture is formed by two adjacent slotted diaphragms that translationally move along one another.

7. The device of claim 4 in which said signalling device (F) is conected to two threshold switches.

* * * * *